United States Patent [19]

Reams

[11] 4,048,645

[45] Sept. 13, 1977

[54] DIAZO EMULSION PROCESSOR

[75] Inventor: Donald J. Reams, Santa Clara, Calif.

[73] Assignee: NBK Corporation, Santa Clara, Calif.

[21] Appl. No.: 730,422

[22] Filed: Oct. 7, 1976

[51] Int. Cl.[2] ..... G03D 7/00

[52] U.S. Cl. ..... 354/300; 354/324

[58] Field of Search ..... 354/300, 299, 324

[56] References Cited

U.S. PATENT DOCUMENTS

| | | | |
|---|---|---|---|
| 3,000,288 | 9/1961 | Winnek | 354/299 |
| 3,147,687 | 9/1964 | Halden | 354/300 X |

FOREIGN PATENT DOCUMENTS

| | | | |
|---|---|---|---|
| 1,365,759 | 9/1974 | United Kingdom | 354/300 |

*Primary Examiner*—R. L. Moses

*Attorney, Agent, or Firm*—Boone, Schatzel, Hamrick & Knudsen

[57] ABSTRACT

Apparatus for use in developing diazo emulsion media (e.g. plates, films, etc.) for use as integrated circuit masks wherein a developing gas is utilized; the apparatus including a developing chamber for housing the media and containing the gas during developing; an accumulator and reservoir for storing the gas when developing is not taking place; a pump for evacuating the developing chamber of air and the developing gas and for pressurizing the gas in the accumulator reservoir; a plurality of solenoid valves for regulating gas flow between the developing chamber, the pump, and the reservoir; and a control unit for automatically controlling the developing process.

5 Claims, 3 Drawing Figures

DIAZO EMULSION PROCESSOR

BACKGROUND OF THE INVENTION

1. Field of the Invention

The present invention relates generally to diazo developing apparatus and more particularly to a diazo developing apparatus using a developing gas, e.g. ammonia gas, in a closed system.

2. Description of the Prior Art

Photographic emulsions and liquid photoresists were essential to the early development of transistors and other semiconductor devices. Today the entire semiconductor industry is dependent on the use of photographic emulsions or photoresists for the manufacture of their devices and circuits. Numerous photoetching steps are applied sequentially in order to form the various active and passive components of integrated circuits.

There are many diverse techniques and processes using photoresist in semiconductor fabrication. However, there are basically only two types of resist; negative-acting resists and positive-acting resists. Negative-acting resists provide an image complementary to that of the photomask and characteristically have a high chemical resistance; good image reproduction qualities; and are of low cost. They have been and are widely used in the manufacture of microelectronic devices for these reasons. Because of their high chemical resistance, the negative-acting resists are generally more difficult to remove than other resists, although there are satisfactory commercial strippers.

Positive-acting resists are totally different from negative resists in response to actinic light and the resulting image, although the essential composition is similar. Both contain sensitizers, resins, solvents and additives. Positive resists provide an identical image, after exposure and developing, to that of the photomask and are colored and soluble in strongly alkaline solutions. They develop in mildly alkaline solutions. General chemical resistance is less than the negative resist, and positives are more costly to procure. However, images from these resists are extremely accurate, require minimal processing technique, and involve few processing steps. Moreover, the use of alkaline stripping and developing solutions greatly simplifies equipment selection by allowing low cost, readily available plastics to be used. However, positive resists suffer from disadvantages in that developing is expensive; it is time consuming; and it must be accurately controlled.

Processes using photographic emulsions having a light sensitive silver coating are also time consuming and difficult, as well as expensive and hard to control. At present there are three primary manufacturers of glass plates having micro images for semiconductor masks. The method of processing the glass plates is similar in all cases. The exposed plate can be processed for a like (positive) image or negative (normal or straight) image depending on chemical sequences. The negative image involves development in an alkaline developer, a wash, treatment in an acid bath to cause the unexposed silver to be water soluble, a final washing and a drying period.

Should a like or positive image be desired the exposed plate must be processed as follows: (1) alkaline development; (2) wash; (3) bleaching out of the developed silver in an acid bath; (4) wash; (5) an alkaline bath to neutralize the acid absorbed into the emulsion; (6) a wash and re-exposure of unexposed silver to light; (7) a redevelopment in an alkaline developer; (8) a wash; (9) treatment in an acid bath to harden the developed silver image; (10) a final wash; and (11) a drying period.

The many disadvantages apparent are chemistry cost, time (20 minutes for negative, 45 to 60 minutes for positive), contamination, necessity of critical control of all stages, expensive processing equipment costs, and resultant grain effects on image edges.

SUMMARY OF THE PRESENT INVENTION

It is therefore a principal object of the present invention to provide a developing apparatus for diazo emulsion media, e.g. plates, films, etc., which apparatus makes use of low-cost, diazo emulsion media.

It is another object of the present invention to provide apparatus for developing diazo emulsion media, which apparatus is capable of rapidly processing the exposed images.

Briefly, a preferred embodiment of an apparatus in accordance with the present invention includes a sealed developing chamber for treating media which have been coated with diazo emulsion and exposed; a developer gas accumulator and reservoir for providing a supply of developer gas to the developing chamber; a pressure pump for evacuating the developing chamber of air and for evacuating the developing gas from the chamber; a plurality of lines for connecting the reservoir with the chamber and for connecting the pump with the reservoir and the chamber; a plurality of solenoid valves connected in lines between the gas accumulator and reservoir for controlling the flow of gases to and from the accumulator, the pump, and the developing chamber; and a control apparatus for controlling the vacuum and pressure pump as well as the plurality of solenoids.

An advantage of the present invention is that it provides a developing apparatus which is low in cost to operate, because gas is reused by recirculating it through a closed loop.

Another advantage of the present invention is that it provides a developing apparatus which allows rapid developing of exposed media.

Still another advantage of the present invention is that it provides an apparatus for developing diazo coated media which does not allow noxious, corrosive or contaminating chemicals or gases to escape into the environment and to pollute the atmosphere.

IN THE DRAWING

DETAILED DESCRIPTION OF THE PREFERRED EMBODIMENT

Figure 1:
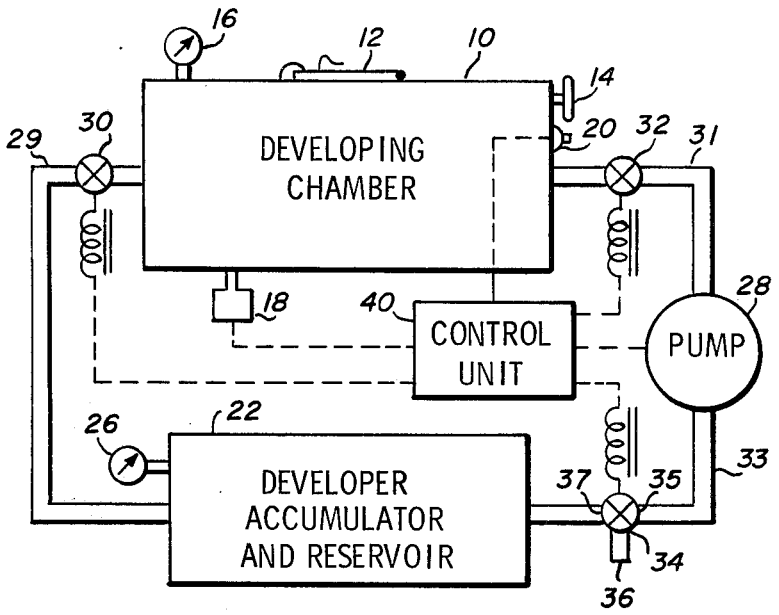
FIG. 1 is a block diagram generally illustrating the principal components of an apparatus in accordance with the preferred embodiment of the present invention.

Referring now to FIG. 1 of the drawing, a block diagram is shown generally illustrating the principal components of an apparatus in accordance with the present invention for developing a diazo emulsion media. The apparatus includes a developing chamber 10 for containing a diazo coated media, e.g. glass plates, to be developed; a latched door 12 joined to the chamber 10, a pressure relief valve 14 for allowing air to enter chamber 10, a pressure indicator 16, a pressure sensor 18 for developing an electrical signal in accordance with the pressure in chamber 10, and a start button 20 for initiating the developing cycle; an accumulator and reservoir 22 for containing pressurized developing gas, e.g. ammonia gas; a pressure gage 26 on the accumulator-reservoir 22; a vacuum pump 28 for drawing a vacuum in the chamber 10; a pressure line 29 having a solenoid 30 connecting reservoir 22 with chamber 10; a vacuum line 31 having a solenoid 32 connecting chamber 10 with the pump 28; a pressure line 33 having a three-way solenoid 34 with ports 35, 36 and 37, for connecting pump 28 to reservoir 22 and for allowing gas in line 33 to escape to the surrounding atmosphere; and a control unit 40. The control unit 40 automatically controls operation of the pump 28 and solenoids 30, 32 and 34. The entire apparatus is enclosed in a suitable housing which is not shown.

Initially, developing chamber 10 contains air at atmospheric pressure. Door 12 is opened and a tray containing exposed diazo media (not shown) is placed inside chamber 10. Door 12 is closed and start button 20 is depressed, which activates control unit 40.

During the first stage of the developing cycle, solenoid 32 and ports 35 and 36 of solenoid 34 open. The pump 28 begins evacuating air from the chamber 10. Pump 28 continues to evacuate chamber 10 until a predetermined vacuum level is reached. Such level is typically about 22 mercurial inches. When sufficient vacuum is achieved, vacuum switch 18 changes state. This causes control unit 40 to generate a signal which closes solenoid 32, stops the operation of pump 28 and opens solenoid 30. The opening of solenoid 30 allows developing gas to flow into developing chamber 10 until the pressure of developing gas in chamber 10 is equal to the pressure of the gas in the accumulator and reservoir 22. At this point, a timing device within control unit 40 is activated which times a developing period sufficient for the developing gas to react with the diazo plates so as to develop those portions of the diazo which have been previously exposed to actinic light.

After the developing period has passed, control unit 40 generates signals which cause the solenoid 32 to open; solenoid 30 to close; port 36 on solenoid 34 to close; port 37 on solenoid 34 to open; and pump 28 to become energized. During this operation, pump 28 evacuates developing gas from the chamber 10 and repressurizes it into the accumulator and reservoir 22. When a preset vacuum level is reached in chamber 10, pressure sensor 18 again changes state causing control unit 40 to develop signals which in turn cause port 37 of solenoid 34 to close; port 36 of solenoid 34 to open; and pump 28 to become de-energized. At this point, relief valve 14 is opened which allows air from the atmosphere to fill chamber 10, door 12 is opened, and the developed diazo glass plates are withdrawn from the chamber.

Figure 2:
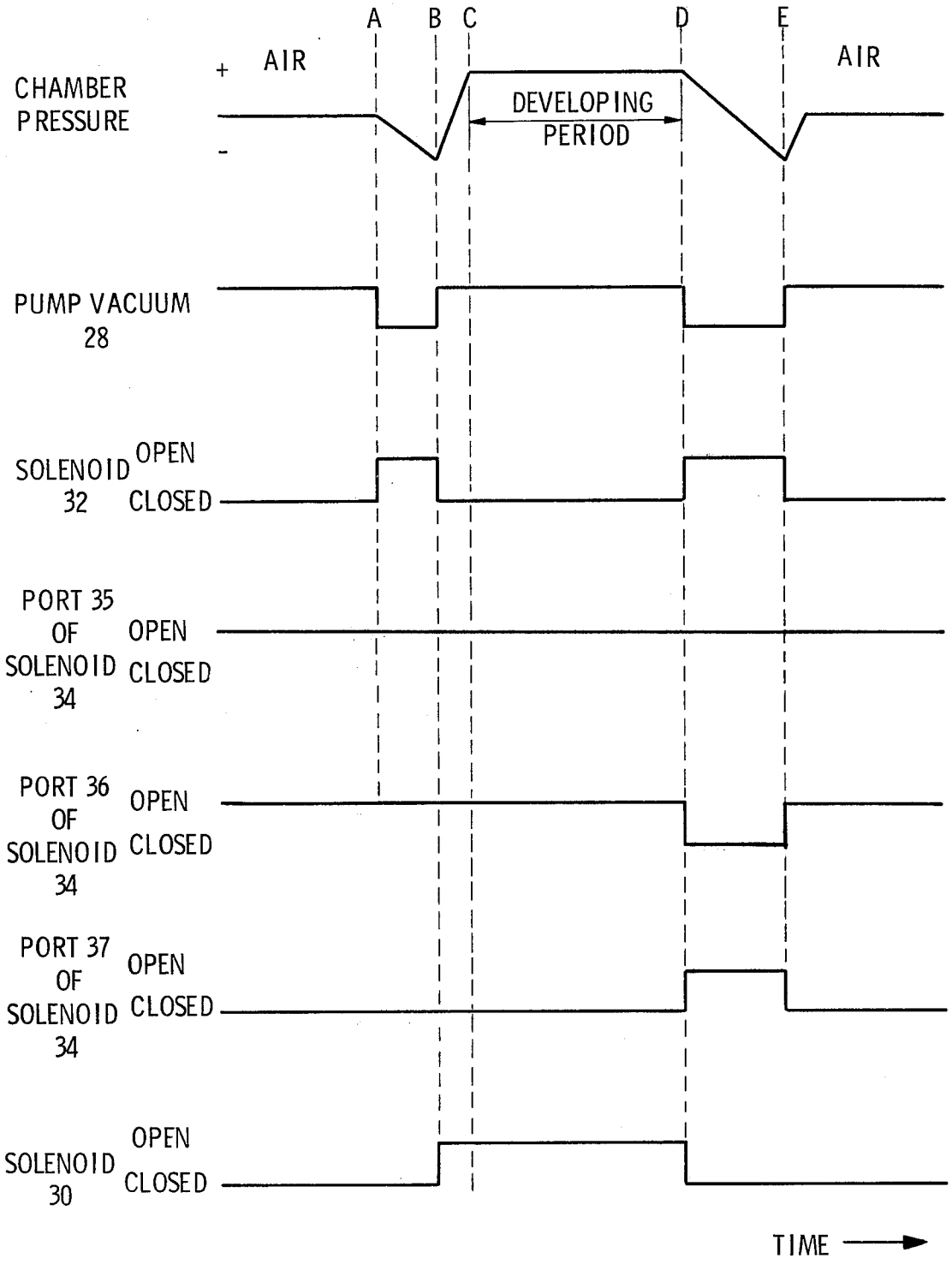
FIG. 2 is a diagram illustrating the interaction of the pump and solenoid valves used in a preferred embodiment of the present invention.

Referring now to FIG. 2, a set of timing diagrams are provided illustrating the interaction between the pressure and contents of developing chamber 10, pump 28, and solenoids 30, 32 and 34. As shown, the chamber 10 is initially filled with the air until such time as the start button 20 is depressed, illustrated as time A, which causes pump 28 to begin operating in a vacuum mode, and solenoid 32 to open.

Pump 28 continues to draw a vacuum until time B when pump 28 ceases operation, solenoid 32 is closed, and solenoid 30 is opened. As previously described, opening solenoid 30 allows developing gas from accumulator and reservoir 22 to fill the vacuum previously developed in chamber 10.

A short time later, at time C, when the pressure of the developing gas in chamber 10 and reservoir 22 have equalized, a developing period begins during which the developing gas reacts with the diazo on the plates within chamber 10.

After a suitable developing time passes, at time D, control 40 causes solenoid 30 to close; solenoid 32 to open; port 37 to open; port 36 to close and pump 28 to be energized so as to draw the developing gas out of developing chamber 10 and force it into accumulator and reservoir 22. This operation continues until time E when a suitable vacuum is achieved and then valve 32 closes. Valve 14 is then opened allowing air to flow into developing chamber 10 which completes the developing cycle.

Figure 3:
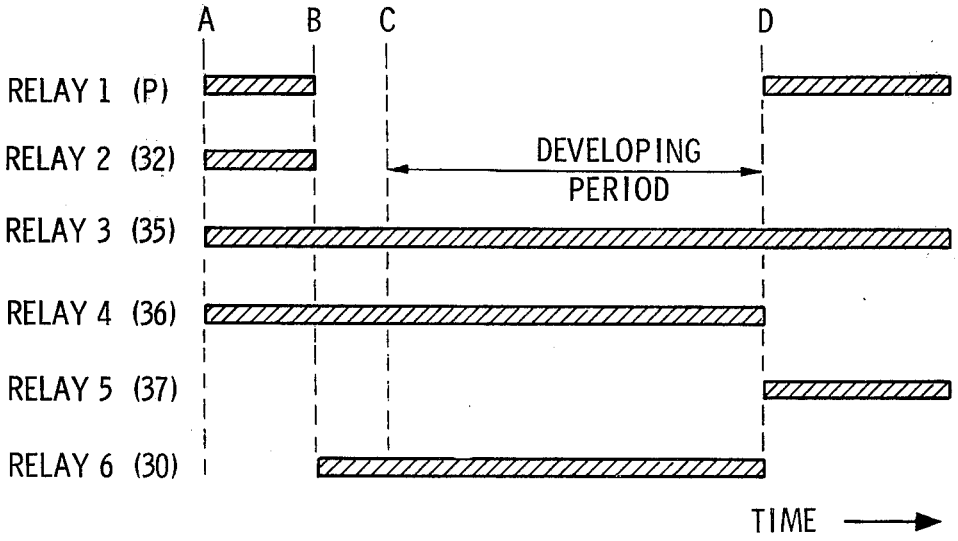
FIG. 3 is a timing diagram illustrating operation of the control unit in the preferred embodiment of the present invention.

The operation of control unit 40 is illustrated by the bar graph of FIG. 3. Control unit 40 includes six time delay relays. Relay 1 controls the time period during which the pump 28, designated P in FIG. 3, is energized and drawing a vacuum in chamber 10. Relays 2, 3, 4, 5 and 6 control solenoid 32, ports 35, 36 and 37 of solenoid 34, and solenoid 30, respectively. As previously described, pump 28 commences to draw vacuum at time A. After a suitable vacuum is achieved, at time B, relays 1 and 2 change state so as to de-energize pump 28 and close solenoid 32, respectively. Relay 6 then causes solenoid 30 to be opened which allows developing gas to flow from reservoir 22 into chamber 10.

After a suitable developing period, relay 5 causes port 37 to open, relay 6 causes solenoid 30 to close, relay 4 changes state causing port 36 to close, and relay 1 causes pump 28 to energize so as to draw the developing gas out of chamber 10 and pressurize it back into reservoir 22.

It should be appreciated that throughout the entire developing cycle of the apparatus no developing gas is released to the surrounding atmosphere.

Although a single embodiment of the invention has been set forth by way of example, it is anticipated that numerous alterations and modifications will become apparent to those skilled in the art after having read the above disclosure. It is therefore intended that the following claims be interpreted to cover all such alterations and modifications as fall within the true spirit and scope of the invention.

What is claimed is:

1. Apparatus for developing photographic images on diazo emulsion media comprising:

a developing chamber means for containing diazo coated media to be developed;

reservoir means for containing a developing gas;

pump means;

first conduit means for establishing a first fluid flow path between said reservoir means and said chamber means, said first path including a first valve means;

second conduit means for establishing a second fluid flow path between said chamber means and said pump means, said second path including a second valve means;

third conduit means for establishing a fluid flow path between said pump means, the atmosphere, and said reservoir means, said third path including a third valve means having a first position for passing fluid to the atmosphere and a second position for passing fluid to said reservoir means; and control means including a plurality of programmable switching means for controlling said pump means and said first, second, and third valve means, said control means causing the apparatus to operate in an operative sequence, first to cause said second valve means to open and said third valve means to open to said first position and said pump means to draw a vacuum in said developing chamber means, second to cause said first valve means to open to allow developing gas to flow from said reservoir means into said developing chamber means, and third, after a predetermined period of time has elapsed, to cause said second valve means to open and said third valve means to open to said second position, and said pump means to evacuate the developing gas from said developing chamber means and to return the developing gas back into said reservoir means.

2. Apparatus as recited in claim 1 wherein said pump means includes an electrically driven vacuum pump.

3. Apparatus as recited in claim 2 wherein said first, second, and third valve means include a first, second, and third electrically operated solenoid valve, respectively.

4. Apparatus as recited in claim 3 wherein said developing chamber means includes six adjoining walls juxtaposed to form an air tight cubicle container.

5. Apparatus as recited in claim 3 wherein said switching means includes:

pressure sensor means for indicating when a predetermined vacuum pressure is reached inside said chamber means; and a plurality of time delay relays, one of said relays being connected to said first solenoid, a different one of said relays being connected to said second solenoid, a different one of said relays being connected to said pump, and a different multiplicity of said relays being connected to said third solenoid, said plurality of relays being responsive to said pressure sensor means and operative to cause said solenoid valves and said pump to operate according to said operative sequence.

* * * * *